US009188114B2

(12) United States Patent
Kuttler et al.

(10) Patent No.: US 9,188,114 B2
(45) Date of Patent: Nov. 17, 2015

(54) CHARGED HYDRAULIC SYSTEM

(75) Inventors: Onno Kuttler, Dalkeith (GB); Luke Wadsley, Edinburgh (GB); Michael D. Gandrud, Ames, IA (US); Pierre Joly, Edinburgh (GB)

(73) Assignee: Danfoss Power Solutions ApS, Nordborg (DK)

( * ) Notice: Subject to any disclaimer, the term of this patent is extended or adjusted under 35 U.S.C. 154(b) by 1040 days.

(21) Appl. No.: 12/261,195

(22) Filed: Oct. 30, 2008

(65) Prior Publication Data

US 2009/0113888 A1 May 7, 2009

(30) Foreign Application Priority Data

Nov. 1, 2007 (EP) ..... 07254336

(51) Int. Cl.

| | |
|---|---|
| ***F15B 13/00*** | (2006.01) |
| ***F04B 23/08*** | (2006.01) |
| ***F04B 1/14*** | (2006.01) |
| ***F04B 7/00*** | (2006.01) |
| ***F04B 23/10*** | (2006.01) |
| ***F04B 23/14*** | (2006.01) |
| ***F04B 49/24*** | (2006.01) |

(52) U.S. Cl.

CPC ..... *F04B 23/08* (2013.01); *F04B 1/145* (2013.01); *F04B 7/0076* (2013.01); *F04B 23/103* (2013.01); *F04B 23/106* (2013.01); *F04B 23/14* (2013.01); *F04B 49/243* (2013.01); *F15B 2211/20592* (2013.01)

(58) Field of Classification Search

CPC ..... F15B 2211/20592
USPC ..... 60/486, 475, 476, 488
See application file for complete search history.

(56) References Cited

U.S. PATENT DOCUMENTS

| | | | | |
|---|---|---|---|---|
| 3,396,536 | A | 8/1968 | Miller et al. | |
| 3,945,208 | A * | 3/1976 | O'Connor | 60/486 |
| 4,002,028 | A * | 1/1977 | Budzich | 60/466 |
| 4,025,238 | A | 5/1977 | Masclet | |
| 4,754,603 | A | 7/1988 | Rosman | |
| 4,798,050 | A * | 1/1989 | Nakamura et al. | 60/468 |
| 5,431,545 | A * | 7/1995 | Knight et al. | 417/248 |
| 5,943,861 | A * | 8/1999 | Davison et al. | 60/486 |
| 6,651,545 | B2 * | 11/2003 | Nippert | 91/476 |
| 7,007,468 | B1 * | 3/2006 | Bennett et al. | 60/488 |
| 2006/0218913 | A1 * | 10/2006 | Ivantysynova et al. | 60/464 |

FOREIGN PATENT DOCUMENTS

DE 4306377 A1 9/1994

* cited by examiner

*Primary Examiner* — F. Daniel Lopez
(74) *Attorney, Agent, or Firm* — McCormick, Paulding & Huber LLP

(57) ABSTRACT

In open-circuit hydraulic systems (1), the cross-sections of the supply lines (6) and input valves of the hydraulic pump (3) have to be large, so that sufficient flow flux can be provided. This hinders a reduction of the size of the pump and the whole hydraulic system. It is suggested that the supply flow (7) of a hydraulic pump (3) is charged by a second, charging pump (2), to a mid-pressure level (7). The cross-sections of the supply flow areas can thus be decreased.

12 Claims, 10 Drawing Sheets

CHARGED HYDRAULIC SYSTEM

CROSS REFERENCE TO RELATED APPLICATION

Applicant hereby claims foreign priority benefits under U.S.C. §119 from European Patent Application No. 07254336.6 filed on Nov. 1, 2007, the contents of which are incorporated by reference herein.

FIELD OF THE INVENTION

The present invention relates to hydraulic systems with at least one hydraulic high-pressure pump and at least one hydraulic charging pump according to the generic part of claim 1. Furthermore, the invention relates to hydraulic pumps.

BACKGROUND OF THE INVENTION

Hydraulic systems are nowadays used for a plethora of different purposes.

One prominent example is the use of hydraulics for generating large forces. For this purpose, usually cylinders and pistons are used. Such devices are used, for example, in locks, steering systems, crawlers, forklift trucks, wheel loaders, and so on. Hydraulic systems for these types of machines are usually referred to as open-circuit hydraulics. This notation is used, because within the hydraulic actuator, for example in the hydraulic cylinder, a variable volume of hydraulic fluid is present. To compensate for these volume changes, a hydraulic fluid reservoir is provided. The hydraulic fluid reservoir is under atmospheric pressure and is usually built as a standard tank. To perform its function as a buffer for the hydraulic fluid, the tank usually has to be of considerable size. Since the hydraulic fluid in the reservoir is under atmospheric pressure, the hydraulic pump takes in hydraulic fluid directly from an atmospheric fluid reservoir. This is a main difference between open-circuit hydraulic systems and closed-circuit hydraulic systems, which are described in the following.

Another application where hydraulic components became very popular are transmissions for vehicles which benefit from continuous variable ratio and wheelspeed combined with high tractive effort over the whole speed range and especially at low speeds. Such transmissions very often use closed-circuit hydraulic pumps and closed-circuit hydraulic motors. The hydraulic motor converts the high-pressure energy of the hydraulic fluid into mechanical energy and sends the hydraulic fluid, now at a lower pressure level, back to the hydraulic pump. Such a system is generally referred to as closed-circuit hydraulics, because the hydraulic pump is sending and receiving almost the same flow rate of hydraulic fluid under all working conditions of the hydraulic circuit. Therefore, no buffer is needed. The low pressure side of such systems normally operates between 10 and 30 bars. Because of this closed-circuit systems normally have fewer problems with filling of the hydraulic pump than open-circuit hydraulic systems.

In real applications, however, even a closed-circuit hydraulic system still has some hydraulic fluid reservoir under atmospheric conditions. First of all, leakage of hydraulic fluid has to be considered. Especially in devices with mechanically moving parts, such as in hydraulic pumps and hydraulic motors, fluid leaks can never be totally avoided. The leakage fluid is therefore collected and transferred to the fluid reservoir via collecting lines. The collected hydraulic fluid is pumped back into the closed-circuit hydraulic system (normally to the low-pressure side of the circuit) by means of a charge pump. Sometimes, a small fraction of hydraulic fluid is taken out of the closed hydraulic circuit for cooling and filtration purposes. This is commonly referred to as "loop flushing". A pressure relief valve and/or an orifice take out a certain percentage of the total fluid flow rate on the low pressure side of the closed-circuit hydraulic system. This flush part of the fluid flows through a heat exchanger and heat can be transferred from the hydraulic fluid to the ambient air. Having passed the heat exchanger and optionally a fluid filter, the fluid is ejected to the hydraulic fluid reservoir. From there, it is pumped back to the main fluid circuit by means of a charge pump, together with the leakage hydraulic fluid. The fraction of hydraulic fluid, used for cooling and filtration purposes, is relatively small and is lower than about 20 percent of the fluid flow rate in the main hydraulic circuit.

While hydraulic systems perform well in practice, they are still undesirably large and expensive for certain applications.

Especially in open-circuit hydraulic systems, problems arise in high performance conditions. Under such high performance conditions the hydraulic pump has to deliver a large flow rate of hydraulic fluid. This, of course, requires the hydraulic pump to receive an appropriate amount of hydraulic fluid from the fluid reservoir. To be able to do this, the suction line of the hydraulic fluid pump has to have a huge cross section, so that a sufficient fluid supply rate to the hydraulic fluid pump can be provided and the pressure drop can be kept low. However, not only the suction line has to have a large cross section, but also the fluid inlet port (e.g. the valve plate of an axial piston machine) of the hydraulic pump needs to be designed with a sufficiently large cross-section. These requirements for large supply cross sections result in relatively large sizes of pump and motor parts, fittings, flanges, hoses and pipes and hence of the overall size of the resulting hydraulic system. This leads to increased costs for the manufacture and use of such hydraulic systems, especially when considering the increased volume requirements in the machine or vehicle, where the hydraulic system is used.

In check ball pump designs the inlet check valve always means an additional flow restriction and the aforementioned problem increases. Normally this results in limited fill speed of such pumps. Very often the inlet valve is actually held close by a spring and the fluid has to work against the spring. The pump has to suck the inlet valve open. Synthetically commutated hydraulic pumps are very similar to check ball pumps when considering the aforementioned problem. In such synthetically commutated hydraulic pumps, also known as digital displacement pumps (which are a unique subset of variable displacement pumps), the fluid valves do not open passively under the influence of pressure differences. Instead, the fluid valves are actively controllable by appropriate valve actuating units which are controlled by an electronic control unit. Even when the inlet valve in a synthetically commutated hydraulic pump is of the normally open type, it provides additional inlet flow restriction which limits fill speed when the pump takes in hydraulic fluid from an atmospheric hydraulic fluid reservoir.

These synthetically commutated hydraulic pumps fall into two groups. In the first group, only the inlet valve is actively controlled, whereas the fluid outlet valve remains passive. With this type, a full stroke pumping mode, a partial stroke pumping mode and a no-pumping mode can be obtained. With the second type, where both inlet and outlet valves are of the actively controllable type, a full or partial stroke back pumping mode/motoring mode can be realised as well. This is known in the state of the art.

The requirement of a large supply cross-section is a major drawback for synthetically commutated hydraulic pumps. Not only valve cross-sections, and therefore the valve head in the valve channel, have to be of large size, but also the valve actuating unit has to be able to deliver a sufficiently large force as well as a sufficiently large travel. This, in turn, increases the costs for such a hydraulic pump. Moreover, the driving unit of the valve has high power consumption. This increases the costs for the manufacture and the actual use of such a hydraulic system even further. On off-highway mobile equipment for instance this would require the installation of large and expensive alternators to generate sufficient electrical power for inlet valve actuation.

SUMMARY OF THE INVENTION

The object of the invention is therefore to provide a hydraulic system with an increased overall performance. Another object of the invention is to provide a hydraulic pump with an increased overall performance.

A hydraulic system and a hydraulic pump, showing the features of the respective independent claims, solve the problem.

It is suggested, that a hydraulic system with at least one hydraulic high-pressure pump and at least one hydraulic charging pump, in which the output hydraulic fluid flow of said hydraulic charging pump is used as the input hydraulic fluid flow of said hydraulic high-pressure pump is designed in a way, that the maximum flow rate of said output fluid flow of said hydraulic charging pump is at least 50 percent of the maximum flow rate of said input fluid flow of said hydraulic high-pressure pump. Put in other words, the performance of the hydraulic charging pump is chosen in a way that it can provide a sufficiently high fluid flow rate, so that this fluid flow rate together with the fluid flow rate being returned from the hydraulic consumers, is sufficiently high, to provide the hydraulic high-pressure pump with a sufficiently high input fluid flow rate, so that the hydraulic high-pressure pump can be running at full speed and maximum displacement, at least under all working conditions which normally can be expected. This, of course, should be even true, if the hydraulic system is an open-circuit hydraulic system, where only a relatively small amount of hydraulic fluid or no hydraulic fluid at all is returned to the input port of the hydraulic high-pressure pump (at least not directly). As long as these conditions are met, the actual percentage can defer from 50 percent as well. For instance, 30 percent, 40 percent, 60 percent, 70 percent, 80 percent and/or 90 percent could be used as a percentage.

Using the suggested design, the pressure of the hydraulic fluid on the fluid supply side of the hydraulic high-pressure pump is elevated above ambient pressure. Therefore, even with the same supply cross section, the fluid supply can be increased, as compared to standard, uncharged hydraulic high-pressure pumps. Therefore, it is possible to decrease the size of the supply cross sections, to increase the performance of the hydraulic high-pressure pump, and/or to increase the maximum shaft speed and/or pumping flow rate of the hydraulic high-pressure pump. If the hydraulic high-pressure pump is of the synthetically commutated type, it is also possible to decrease the power consumption of the pump. Particularly it is possible to decrease the electrical power consumption of the actuated valves (if electrical power is used for valve actuation). Further advantages are, that the proposed hydraulic system can be used at higher altitudes and, because of the decreased risk of cavitation, the wear of the hydraulic high-pressure pump can be decreased.

Preferably, the maximum flow rate of said output fluid flow of said hydraulic charging pump is at least essentially the same as or higher than the maximum flow rate of said input fluid flow of said hydraulic high-pressure pump. With this design, it is possible to run the hydraulic system at high performance levels even in situations, where no hydraulic fluid at all (at least not directly) is returned from the hydraulic consumer. This design is particularly useful in open circuit hydraulic systems, of course. In particular, the maximum flow rate of said output fluid flow of said hydraulic charge pump can be 100 percent, 105 percent, 110 percent, 115 percent, 120 percent, 125 percent or 130 percent of the maximum flow rate of said input fluid flow of said hydraulic high-pressure pump. This way, leakages can be accounted for and the loop flushing principle can be implemented.

The output pressure of said hydraulic charging pump can be regulated to be between 0.3 to 10 bars, preferably 0.5 to 7 bars, more preferably 1 to 5 bars, even more preferably 1.5 to 3 bars, most preferably 2 to 2.5 bars. The given pressures are meant to be pressures above ambient atmospheric pressure (or standard atmospheric pressure). Even a slight increase in the charging pressure of the hydraulic high-pressure pump can lead to a significant increase in performance. This can be easily understood, when considering a pressure drop of 0.3 bars along the fluid supply line (including the fluid inlet valve) as an example: If the fluid reservoir has a pressure, which is equal to the atmospheric pressure, the pressure drop amounts to 30 percent of the pressure available. If, however, the input-pressure is charged to 1 bar above atmospheric pressure (i.e. 2 bars absolute) the pressure drop is now only 15 percent of the total pressure available. Roughly speaking, this can lead to a performance increase of about 50 percent. Because a quite small pressure increase by the charging pump is sufficient, the loading pump can be quite small, simply and durably designed and inexpensive to manufacture. Nevertheless, the overall performance can be increased substantially.

If necessary, a plurality of hydraulic high-pressure pumps and/or a plurality of hydraulic charging pumps can be provided. It is possible, that a single hydraulic charging pump supplies several hydraulic high-pressure pumps. On the contrary, it is also possible that a plurality of hydraulic charging pumps serve a single hydraulic high-pressure pump. Also, it is possible that several pumps are arranged in parallel, wherein every hydraulic high-pressure pump has its own, dedicated hydraulic charging pump.

In a preferred embodiment of the invention, at least one hydraulic high-pressure pump is a synthetically commutated hydraulic pump. As already mentioned, the proposed hydraulic system is particularly useful when synthetically commutated hydraulic pumps are used. Although it is possible that the hydraulic charging pump is of a synthetically commutated type as well, normally a different type of pump is chosen for the hydraulic charging pump for cost reasons. In general, synthetically commutated hydraulic pumps, particularly charged synthetically commutated hydraulic high-pressure pumps have the following advantages: They have smaller and cost effective inlet (flow pressure) valves; they have a higher flow speed, even at high or maximum displacement of the pump; they have smaller ports and smaller diameters of supply lines (e.g. hoses, pipes and fittings); they can have smaller internal ports and hence reduction in size and weight is possible; prevention of cavitation and hence less wear is possible; the hydraulic system can be used at higher altitudes.

It is suggested that at least two hydraulic pumps are driven by the same power source. Especially, a hydraulic high-pressure pump and its dedicated hydraulic charging pump can be driven by the same power source. As a power source, a combustion engine, an electric motor, a turbine or the like can be used. In particular, a power source could mean a mechanical power source. The power source can be connected to the pumps by a rotatable shaft, for example.

Preferably, at least one hydraulic charging pump is of a self-delimiting type. By a self-delimiting type, a design is meant, wherein a pressure increase on the output side of the pump automatically delimits the fluid flow rate, pumped by the change pump. For example, an impeller-like pump can be used.

Also, instead of a self-delimiting pump, a pump, in particular a positive displacement pump, could be used as a charge pump in which a check valve or a pressure relief valve is used to purge excess flow back from the charging pump to the hydraulic fluid reservoir. Such a circuit can have similar performance like the use of a "genuine" self-delimiting charge pump. Such a purge valve can also be useful, when several flow sources are combined for charging, e.g. flow from the charge pump, return flow from the main system (driven by the hydraulic high-pressure pump) and/or return flow from another sub-system (e.g. a steering system supplied with hydraulic fluid by a separate hydraulic pump, e.g. a gear pump). These different flow sources might be decoupled from each other by additional check valves, if necessary. The check valve with appropriate spring rate can purge excess flow back to the reservoir tank and can ensure that sufficient charge pressure at the right level will be available. In cases where synthetically commutated hydraulic high-pressure pumps are used as high-pressure pumps, the purge valve can also allow flow reversal through the hydraulic high-pressure pump during motoring mode.

In particular, it is suggested that at least one hydraulic charging pump is of a fluid jet pump type. The design is based on the principle of a water ejector pump. This design can be very simple, durable, inexpensive and self-delimiting. As the driving fluid jet, the hydraulic fluid, being returned from a hydraulic consumer, or the fluid flow of a special pump can be used. Particularly in off-highway applications, very often a second pump is used to provide flow to another sub-system. A typical sub-system can be a steering system supplied e.g. by a gear pump as the second pump. The return flow from such a sub-system (e.g. from the steering system) can be used to drive the fluid-jet pump.

Preferably, at least one hydraulic pump is designed as a two stage pump. Particularly a hydraulic high-pressure pump is designed as a two stage pump. Using such a design, it is possible to design the pumps very simple and inexpensive. Such an integrated two stage pump can be especially suitable for systems with one dedicated charge pump per hydraulic high-pressure pump. Nevertheless, a relatively high overall charging pressure and/or flow rate can be provided for the hydraulic high-pressure part of the pump. An example is the use of a fluid-jet type pump or an impeller type pump as a charging stage. In particular, such a two-stage pump can be used as the only pump, present in the hydraulic system. Also, a charging pump of the system can be a two-stage pump as well. For example, an impeller pump could drive a fluid jet pump.

A possible embodiment of the invention can be obtained when the output fluid flow of the hydraulic high-pressure pump is joined with the output fluid flow of the hydraulic charging pump, after the output fluid flow of the hydraulic high-pressure pump has passed a hydraulic consumer, and the thus combined fluid flows are used as the input fluid flow of the hydraulic high-pressure pump. Here, the still somewhat elevated pressure of the hydraulic fluid, even after the hydraulic fluid has passed the respective hydraulic consumer, can be used as a charged input fluid flow. The elevated pressure can even be created artificially by inserting a check valve with an appropriate spring rate. This can save energy, because it is not necessary to first reduce hydraulic fluid pressure to ambient pressure and to pressurise the hydraulic fluid again. If a high capacity charging pump is used, the high-pressure pump—and therefore the whole hydraulic system, including the hydraulic consumer, supplied by the fluid flow of the high-pressure pump—can still run at full performance, even in conditions, where not all flow from the hydraulic system or consumer (or even only a minor fraction of the flow, pumped to the hydraulic system or consumer) is returned because of e.g. the use of differential hydraulic cylinders.

Preferably, the output fluid flow of at least one hydraulic charging pump is used at least partially for a hydraulic consumer. Partially can stand for a mode, where the output fluid flow rate of the hydraulic charging pump is used for a hydraulic consumer during certain time intervals. Alternatively or additionally, it is possible that a certain fraction of the output fluid flow rate of the hydraulic charging pump is used for a hydraulic consumer. The hydraulic consumer can be a device with low priority, or at least with a lower priority than the hydraulic consumer, which is supplied by the hydraulic high-pressure pump. For instance, the output of the hydraulic high-pressure pump could be used for a steering device, while the low priority consumer is a mixing device of a concrete delivery truck. By such a design, the hydraulic charging pump can be used in an optimal manner.

Another possible embodiment of the invention can be achieved, if at least one hydraulic consumer can be alternatively supplied by the output fluid flow of at least one hydraulic high-pressure pump and/or the output fluid flow of at least one hydraulic charging pump. This design is particularly useful for a hydraulic consumer that can be run at several pressure levels, whereas certain functions or a certain output force of the hydraulic consumer can only be reached at higher pressures. If, for instance, the hydraulic consumer is a hydraulic cylinder for lifting loads, the hydraulic cylinder can be fed by the charging pump, if only small loads are to be moved. However, the speed can be high, due to the high output-fluid flow rate of the charging pump. Also, energy can be saved. If, however, heavy loads are to be lifted, the hydraulic cylinder can be moved by the hydraulic high-pressure pump, although the speed is slower.

A very compact and preferable design of a hydraulic pump can be achieved, if the hydraulic pump comprises at least a first, charging stage and a second, high pressure stage. By such a design, a hydraulic charging pump and a hydraulic high-pressure pump can be integrated into just one device. This device can be used as a drop-in solution for already existing hydraulic systems.

Preferably, the charging stage can comprise an impeller device and/or a fluid jet device. Using such a design, the already mentioned effects and advantages can be achieved for a two-stage hydraulic pump in a similar way, as well.

Preferably, both stages are driven by a common driving shaft, and are preferably mounted on said driving shaft. This design is particularly useful, if an impeller pump is used. Once again, the already described advantages and effects can be achieved similarly.

Another embodiment of the invention can be achieved, if the output hydraulic fluid flow of the hydraulic charging pump is at least partially going through a hydraulic consumer, before being used as the input fluid flow of the hydraulic high-pressure pump. This aspect of the invention can even be used in conventional closed circuit hydraulic systems, particularly in closed circuit systems with a loop flushing. By the proposed design, the energy output of the hydraulic charging pump can be used, for instance, during operation modes where a lower output flow rate of the hydraulic charging pump is needed, and the performance of the charging pump can therefore be used for generating a higher pressure, instead of generating a higher fluid flow rate. By this design, already mentioned effects and advantages can be achieved in a similar way.

Although in the previous description, as well as in the following description, references are made mainly to hydraulic pumps, it is to be understood, that the hydraulic pumps can also be used in a reversed pumping mode and/or a motoring mode, as well. However, the proposed invention, as well as its suggested various designs are particularly useful in the full and/or part-stroke pumping mode.

If, however, the hydraulic high-pressure pump should be used in a motoring mode, it is possible to by-pass the charging pump, using a check valve with an appropriate spring rate, for example. It is also possible to use both pumps in a motoring mode, of course. Another possibility is, that the charging pump is of a design, so that it is essentially no problem for the respective pump, when fluid flow is reversed. Fluid jet pumps can, for instance, be of such a design.

BRIEF DESCRIPTION OF THE DRAWINGS

The objects, advantages and effects of the present invention will be elucidated by the following description of certain embodiments of the invention, which are described using the enclosed figures. The figures are showing.

DETAILED DESCRIPTION

In the following description, the same reference numbers are used for similar devices, shown within different figures. This does not necessarily mean, that the referenced devices are identical in design or function. However, the principle function or design of the respective device is similar.

In the figures one common drive shaft 11 for all pumps is shown. Of course the pumps can also be driven by different shafts and with different shaft speeds. This is often the case when some pumps are driven by the crank shaft of a combustion engine and some other pumps are e.g. mounted on a PTO (Power Take Off; split drive shaft) of the engine or the gear box. In such cases the different shaft speeds have to be considered during system design. However, this does not limit the applicability of the invention.

Figure 1:
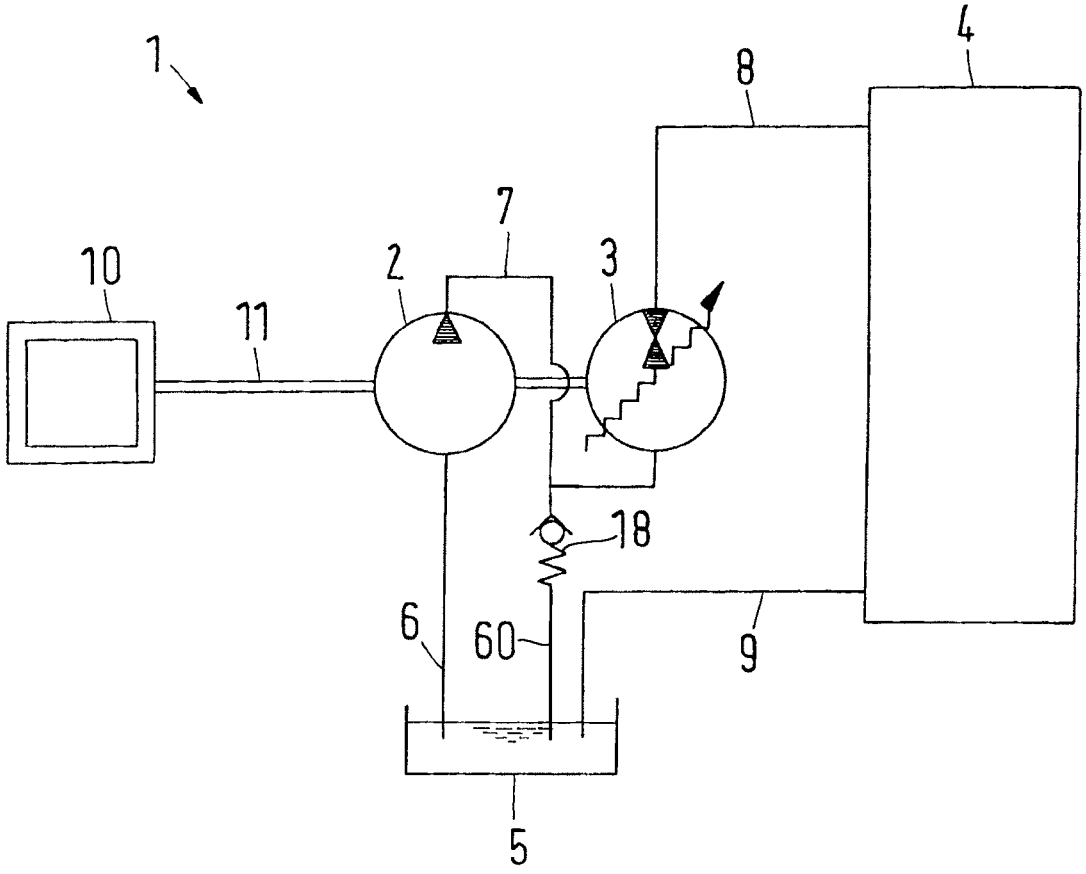
FIG. 1 is a schematic diagram of a first example of a charged hydraulic circuit, wherein a single charging pump and a single high-pressure pump are used.

FIG. 1 shows a schematic diagram of a charged, open-circuit hydraulics 1. The hydraulic circuit 1 comprises a charging pump 2, a synthetically commutated hydraulic pump 3 (also known as digital displacement pump or variable displacement pump), serving as a high-pressure pump, a hydraulic machine 4, powered by the pressurised hydraulic fluid and a fluid tank 5, serving as a reservoir for the hydraulic fluid. The components are interconnected by fluid lines 6, 7, 8, 9, 60, which may be hoses, pipes or internal passages within an assembly.

The charging pump 2 and the synthetically commutated hydraulic pump 3 are driven by a common mechanical energy source 10, in the example shown a combustion engine, via a common rotatable shaft 11. Therefore, whenever the combustion engine 10 is running, both the charging pump 2 and the synthetically commutated hydraulic pump 3 are driven at the same time.

Although not shown, the combustion engine 10 can also drive an electric generator, producing electric energy, which can be used for powering the actively controlled valves of the synthetically commutated hydraulic pump 3.

The hydraulic machine is of a type, where the input fluid flow, provided by the high-pressure line 8, is not necessarily equal to the hydraulic output fluid flow to the returning line 9. For example, the hydraulic machine 4 could be a hydraulic cylinder. Therefore, the volume of hydraulic fluid within the hydraulic circuit 1 is highly variable. Excess charge flow from charge pump 2 which is not needed by high-pressure pump 3 is purged via charge pressure relief valve 18 and pressure relief line 60 back to the fluid tank 5. The pressure relief valve 18 is of course only needed when charge pump 2 is of a non-self-delimiting type, e.g. a positive displacement type.

To compensate for these variations in "captured" hydraulic fluid volume, a sufficiently large fluid tank 5, containing hydraulic fluid, is provided. The fluid tank 5 is exposed to ambient pressure, i.e. usually about one bar. However, in certain applications, such as in planes or in machinery, designed to be used at high altitudes (e.g. mountainous areas) this pressure can be much lower.

The hydraulic fluid, contained within the fluid tank 5, is sucked into the charging pump 2 via suction line 6. To minimise the pressure losses between the fluid tank 5 and the charging pump 2, and to maximise the fluid throughput, the suction line 6 and the inlet area of the charging pump 2 show relatively large cross sections. The charging pump 2 pressurises the hydraulic fluid to a slightly elevated pressure, which is present in the mid-pressure line 7, and adjacent parts of the charging pump 2 and the synthetically commutated hydraulic pump 3. In the example, shown in FIG. 1, the elevated pressure is chosen to be about 2 to 3 bars above ambient pressure.

Although the pressure difference between ambient pressure and elevated pressure is relatively low, the increase in performance of the hydraulic circuit 1 is quite remarkable. Because of the elevated pressure within the mid-pressure line 7, the mid-pressure line's 7 cross section can be smaller, and still a high fluid flux can be achieved.

Figure 7:
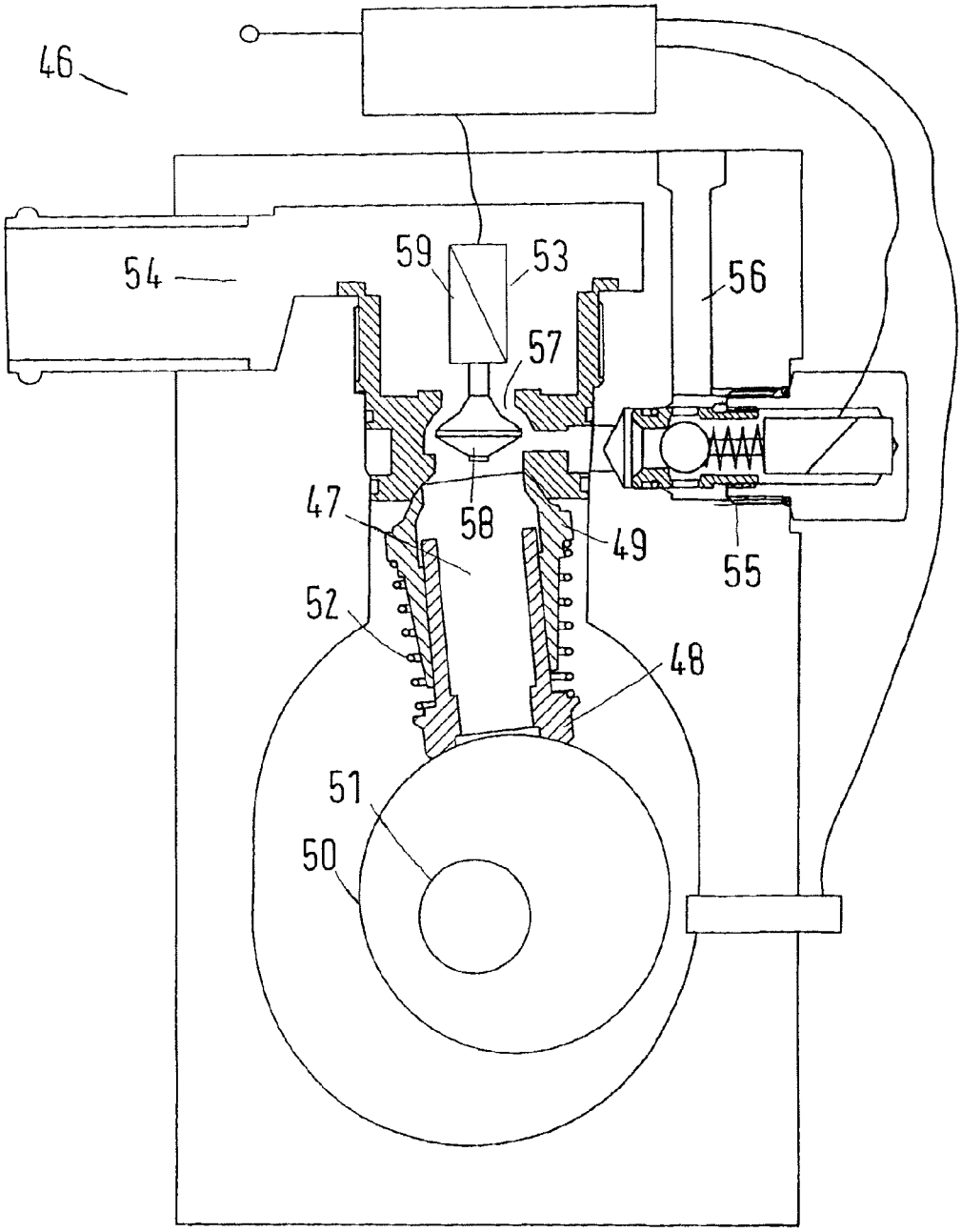
FIG. 7 is a schematic cross section through a synthetically commutated hydraulic pump.

More important, however, not only the cross section of the mid-pressure line 7, but also the cross sections of the fluid inlet line 54 and the inlet valves fluid cross sections 57 can be chosen smaller, and still a sufficient fluid flow rate can be maintained (see FIG. 7). Also, the speed of the synthetically commutated hydraulic pump 46 can be chosen higher, because of the higher input fluid flow (this idea can be used for other circuits as well).

The hydraulic fluid, pressurised by the synthetically commutated hydraulic pump 3, is expelled into the high-pressure line 8. Typical pressure values for the high-pressure line 8 are between 200 bars to 500 bars, depending on the application. However, different pressures can be chosen as well.

The high-pressure line 8 is connected to the hydraulic machine 4, thus providing the hydraulic machine 4 with the necessary fluid supply rate. The fluid machine 4 can be almost any suitable hydraulic machine, known in the state of the art. A detailed description is omitted for brevity.

Finally, the hydraulic fluid, leaving the hydraulic machine at a reduced pressure, is returned to the fluid tank 5 via the returning line 9.

Figure 2:
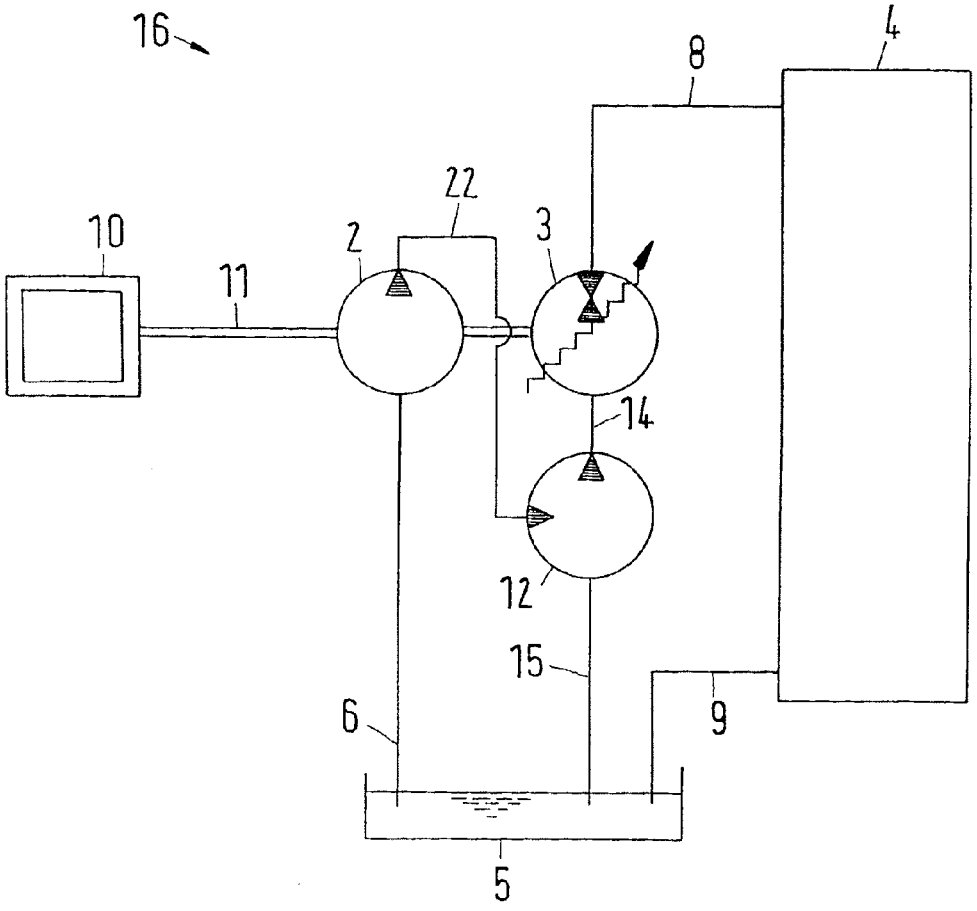
FIG. 2 is a schematic diagram of a second example of a charged hydraulic circuit, wherein a two-stage charging pump and a single high-pressure pump are used.

In FIG. 2, an example for a two-stage charged, open-circuit hydraulics 16 is shown.

Similar to the open circuit hydraulics 1, shown in FIG. 1, the two-stage charged hydraulic circuit 16 according to the example shown in FIG. 2, comprises a charging pump 2, a synthetically commutated hydraulic pump 3, a hydraulic machine 4 and a fluid tank 5. Charging pump 2 and synthetically commutated hydraulic pump 3 are driven by combustion engine 10 via a common rotatable shaft 11.

Contrary to the open circuit hydraulics 1, shown in FIG. 1, in the present example of a two-stage charged hydraulic circuit 16, the output fluid flow of the charging pump 2 is not going directly to the synthetically commutated hydraulic pump 3, but instead the output fluid flow is directed through the elevated pressure line 22 to a second charging pump 12, which is designed as a fluid jet pump 12 in the example shown. The basic design of fluid jet pump 12 is similar to a hydrostatic jet pump, used e.g. in chemistry. Therefore, the hydraulic fluid, entering the fluid jet pump 12 through the elevated pressure line 22, will cause additional hydraulic fluid, to be sucked in from the fluid tank 5 into the fluid jet pump 12 through the second suction line 15. Therefore, an "amplified" fluid flow will leave the fluid jet pump 12 in the direction of the mid-pressure line 14. The mid-pressure line 14 will feed the synthetically commutated hydraulic pump 3, which in turn will feed the hydraulic machine 4.

The fluid jet pump 12 converts the pressure energy of the hydraulic fluid in the elevated pressure line 22 into an increased amount of hydraulic fluid at the lower pressure level of the mid-pressure line 14. A comparatively small and inexpensive charging pump 2 can therefore provide a quite large fluid flow rate for the synthetically commutated hydraulic pump 2, with the help of the fluid jet pump 12.

Figure 3:
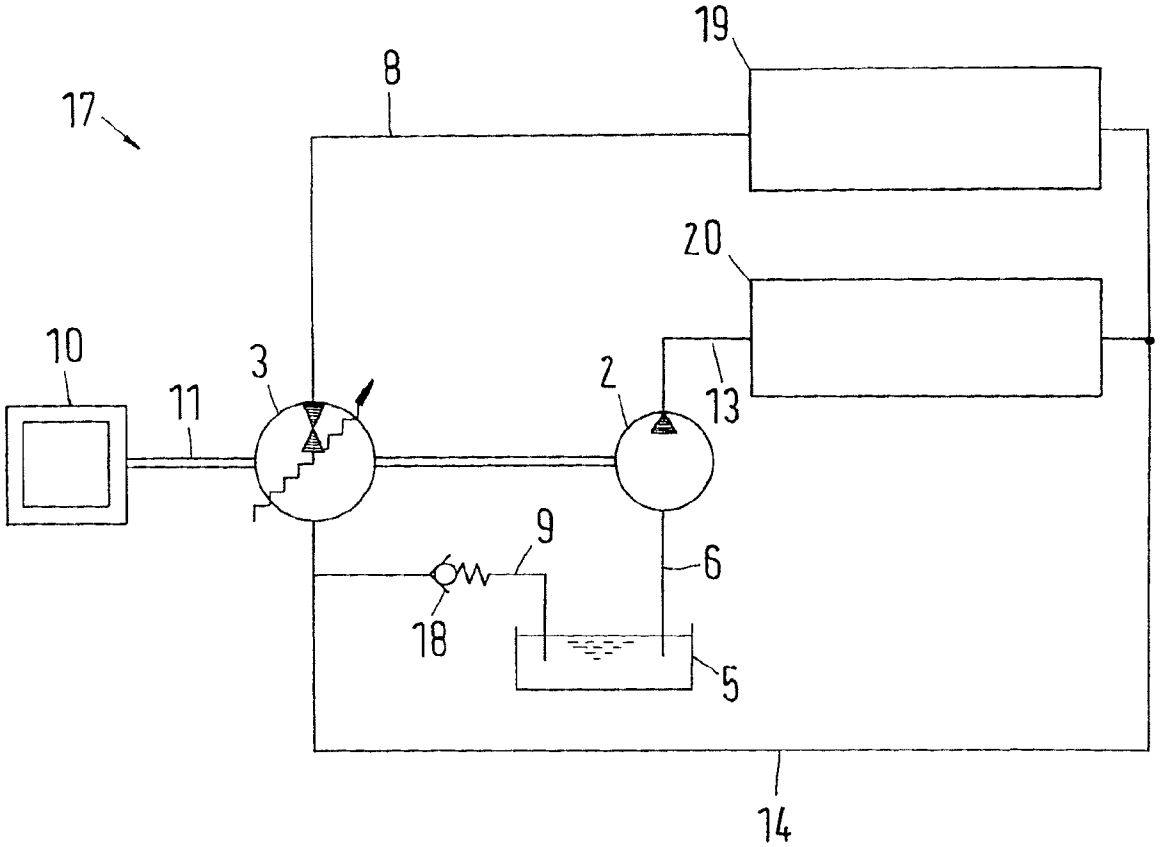
FIG. 3 is a schematic diagram of a third example of a charged hydraulic circuit, wherein the hydraulic circuit is an only partially open circuit hydraulic system.

FIG. 3 shows an example for a partially closed circuit hydraulics 17. Once again, the partially closed circuit hydraulics 17 comprises a synthetically commutated hydraulic pump 3 and a charging pump 2, which are driven by a combustion engine 10 via a common rotatable shaft 11.

The hydraulic circuit 17, shown in FIG. 3, is partially closed, in the sense that the fluid flow, leaving the synthetically commutated hydraulic pump 3 in the direction of a first hydraulic machine 19 via the high-pressure line 8, is not necessarily returned to the fluid reservoir 5 after leaving the first hydraulic machine 19. Instead, the fluid, leaving the first hydraulic machine 19, enters the mid-pressure line 14 which serves as the fluid input line for the synthetically commutated hydraulic pump 3. However, the partially closed circuit hydraulics 17 still differs from normal closed circuit hydraulics, and even from a closed circuit hydraulics using a loop flushing, as will be come clear from the following description.

In the partially closed circuit hydraulics 17, the first hydraulic machine 19 can be of a type where the input fluid flow and the output fluid flow of said first hydraulic machine 19 can be substantially different. So the first hydraulic machine 19 can be in a working condition, where the return fluid flow is substantially higher (e.g. twice as high) as the input fluid flow. It is even possible that the first hydraulic machine 19 does not receive any hydraulic fluid at all, but does return a substantive amount of hydraulic fluid. In such condition the hydraulic fluid entering the mid-pressure line 14 exceeds the amount of hydraulic fluid, leaving the mid-pressure line 14 through the synthetically commutated hydraulic pump 3. This excess amount will be discharged by a spring loaded check valve 18 into the fluid tank 5 through returning line 9.

If, on the contrary, the first hydraulic machine 19 uses hydraulic fluid, without returning any hydraulic fluid into the circuit (or returning only a small fraction of the input fluid flow rate), the hydraulic fluid now needed in the mid-pressure line 14 will be provided through the charging pump 2. The charging pump 2 accepts hydraulic fluid from the fluid tank 5 via the suction line 6 and will discharge this hydraulic fluid at an elevated pressure into the elevated pressure line 13. Before entering the mid-pressure line 14, the hydraulic fluid first performs some useful work in the second hydraulic machine 20. It should be noted that the charging pump 2 is able to pump hydraulic fluid and therefore to power the second hydraulic machine 20 in any working state of the partially closed circuit hydraulics 17 or first hydraulic machine 19, because excess fluid in the mid-pressure line 14 will be discharged through the spring loaded check valve 18 into the fluid tank 5.

The partially closed circuit hydraulics 17 can be equally realised if the second hydraulic machine 20 is omitted and replaced by a simple fluid line. Also, a bypass-line, bypassing the second hydraulic machine 20 at least in part, can be provided.

It should be understood that the exact pressure levels of the high pressure line 8, the elevated pressure line 13, the mid-pressure line 14, the suction line 6 and the return line 9 might be different from the respective line, shown in the examples of FIGS. 1 and 2. This statement is true for all figures.

Figure 4:
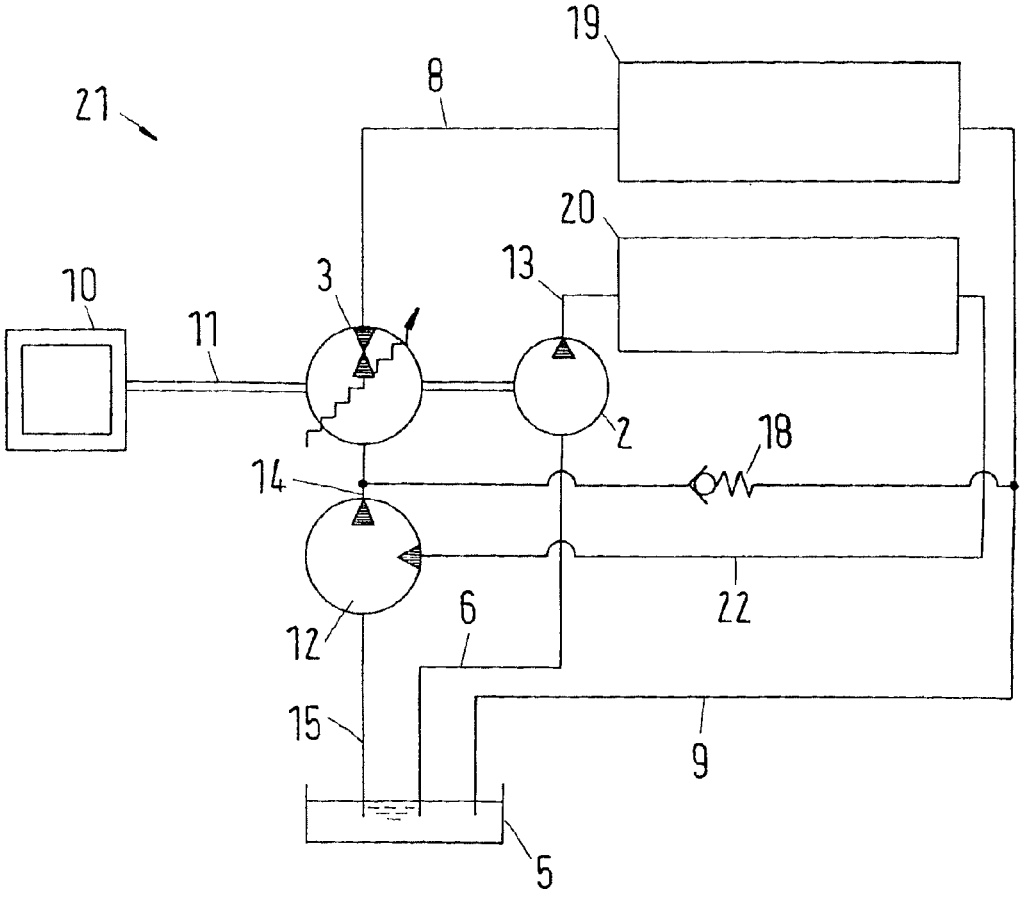
FIG. 4 is a schematic diagram of a fourth example of a charged hydraulic circuit, wherein the return flow of a hydraulic consumer is used to drive a jet pump, which is used as the charge pump.

In FIG. 4, a schematic diagram of a modified partially closed circuit hydraulics 21 is shown. In some sense, the modified partially closed circuit hydraulics is a combination of ideas, taken from FIG. 2 and FIG. 3.

The modified partially closed circuit hydraulics 21 again comprises a charging pump 2 and a synthetically commutated hydraulic pump 3. Both pumps are driven by a combustion engine 10 through a common rotatable shaft 11.

The fluid, expelled by the synthetically commutated hydraulic pump 3 is fed to the first hydraulic machine 19 via the high-pressure line 8. Hydraulic fluid, leaving the first hydraulic machine (where the ratio of the input flow rate and output flow rate can vary) is returned directly to the fluid tank 5 via the returning line 9. However, the input fluid flow of the synthetically commutated hydraulic pump 3 does not come directly from the charging pump 2 (via a direct line, a bypass-line or via the second hydraulic machine 20).

Instead, the hydraulic fluid is sucked in by the charging pump 2 from the fluid tank 5 via suction line 6 and expelled to the elevated pressure line 13. From there, the hydraulic fluid performs some work in the second hydraulic machine 20 from where it is expelled into the connecting line 22. This fluid flow is used as a driving input of a fluid jet pump 12. As already described, the fluid jet pump 12 "amplifies" the fluid flow, flowing through the stage connecting line 22, and the thus "amplified" common fluid flow is expelled into mid-pressure line 14. The mid-pressure line 14 serves as the input line for the synthetically commutated hydraulic pump 3. Spring-loaded check valve 18 (or alternatively a pressure release valve) is used as a purge valve to spill excess charge flow from mid-pressure line 14 via return line 9 to fluid tank 5. Since charge pump 12 is of a self delimiting type in this example, purge valve 18 is optional and not essential for the protection of the charge pump 12 and for the hydraulic system. However, the spring-loaded check valve 18 would be necessary, if the charge pump 12 is constructed in a way that no "backward flow" from connecting line 22 to second suction line 15 is possible. Of course, a bypass-line, bypassing the second hydraulic machine 20 can be provided as well.

Of course, such a spring loaded check valve 18 can be used at different places and within different embodiments, as well. For instance, such a spring loaded check valve 18 could be used in the example of FIG. 2 between elevated pressure line 22 and return line 9 and/or between mid-pressure line 14 and return line 9. However, if in the examples of FIGS. 1 and 2 the charging pumps 2 are of a self-limiting type, such a spring-loaded check valve 18 can be omitted as well.

Figure 5:
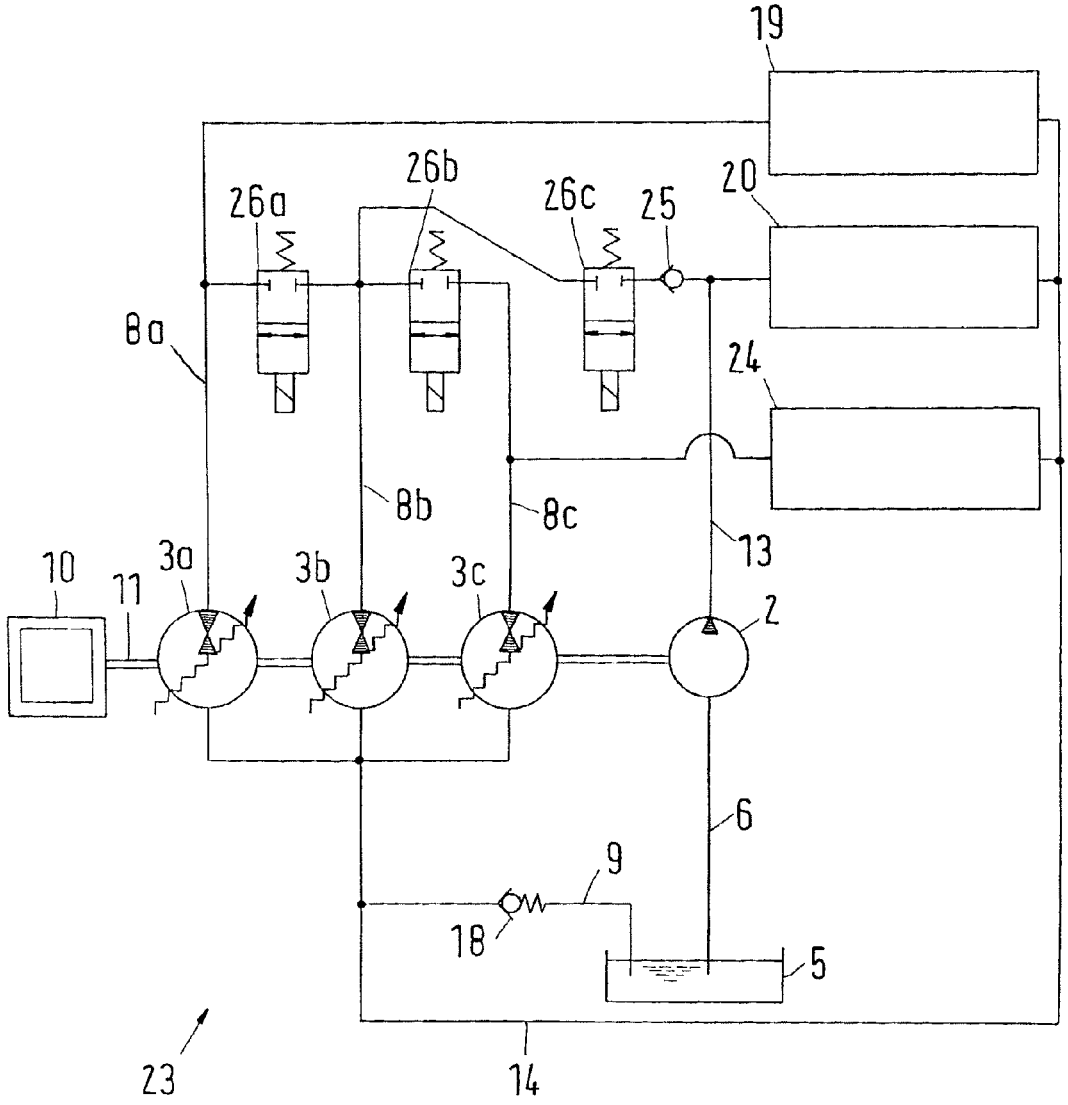
FIG. 5 is a schematic diagram of a fifth example of a charged hydraulic circuit, wherein several high-pressure pumps and several hydraulic consumers are present and which is an only partially open circuit hydraulic system.

In FIG. 5, a multi machine hydraulic circuit 23 is shown as another example of a hydraulic circuit. To some extent, the multi machine hydraulic circuit 23 of FIG. 5, resembles the partially closed circuit hydraulics 17 of FIG. 3.

Hydraulic fluid from the fluid tank 5 enters the charging pump 2 via suction line 6.

The multi machine hydraulic circuit 23 comprises a single charging pump 2 and three synthetically commutated hydraulic pumps 3*a*, 3*b*, 3*c*, which are driven by the same combustion engine through a rotatable shaft 11.

The hydraulic fluid expelled by the charging pump 2 enters the second hydraulic machine 20 via the elevated pressure line 13. The hydraulic fluid, leaving the second hydraulic machine 20 (or bypassing the second hydraulic machine 20 via a bypassing line) forms part of the fluid flow, entering the mid-pressure line 14, which is the feeding line for the synthetically commutated hydraulic pumps 3*a*, 3*b*, 3*c*. In case there is an excess flux into the mid-pressure line 14, a spring loaded check valve 18 serves as a relief valve and hydraulic fluid is expelled to the fluid tank via returning line 9.

The high-pressure output of the three synthetically commutated hydraulic pumps 3*a*, 3*b*, 3*c* is expelled into respective high pressure lines 8*a*, 8*b*, 8*c*. First hydraulic machine 19 and third hydraulic machine 24 are directly connected with first high pressure line 8*a* and third high pressure line 8*c*, respectively.

Additionally, three electrically actuated valves 26*a*, 26*b*, 26*c* are provided. Using first electrically actuated valve 26*a*, first high pressure line 8*a* and second high pressure line 8*b* can be fluidly connected or disconnected. Similarly, using second electrically actuated valve 26*b*, second high pressure line 8*b* and third high pressure line 8*c* can be fluidly connected or disconnected.

Using third electrically actuated valve 26*c*, it is possible to connect second high pressure line 8*b* to elevated pressure line 13, and therefore to second hydraulic machine 20. A check valve 25 is provided between second high pressure line 8*b* and elevated pressure line 13 for safety reasons. In case consumer 20 is a steering system, check valve 25 assures that at least the output flow from pump 2 is exclusively available for consumer 20.

By appropriately switching the electrically actuated valves 26*a*, 26*b*, 26*c*, an optimum performance of the multi machine hydraulic circuit 23 can be reached for almost every thinkable workload condition of the three hydraulic machines 19, 20, 24.

Figure 6A:
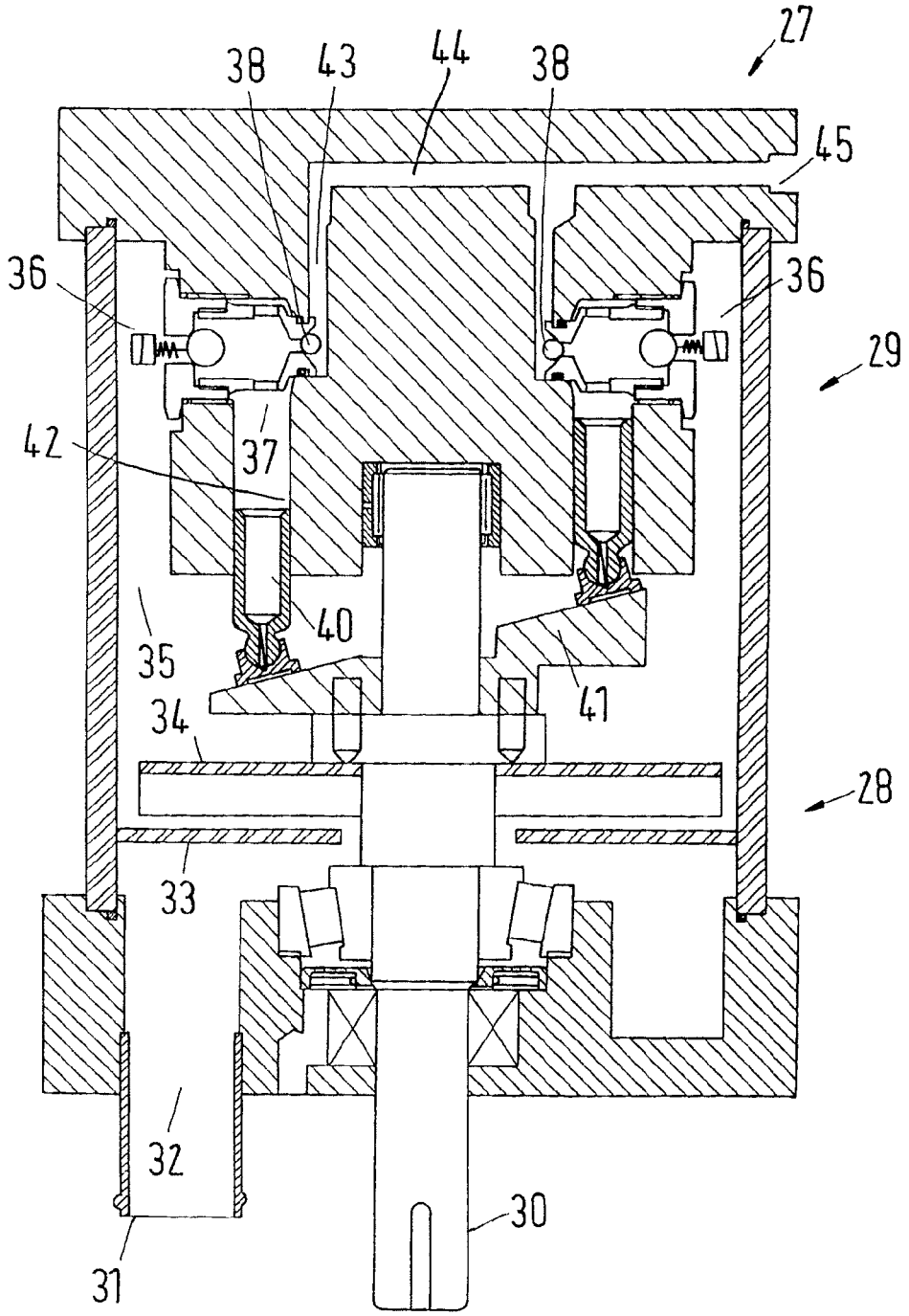
FIG. 6A is a first example of an integrated hydraulic pump with a charging stage and a high-pressure stage.

FIG. 6A shows a first example of a dual stage hydraulic pump 27, comprising a charging stage 28 and a high pressure stage 29. The dual stage hydraulic pump therefore integrates a charging pump 2 and a synthetically commutated hydraulic pump 3 into a single pump 27. Both stages 28, 29 are driven by a common rotatable shaft 30.

Hydraulic fluid, entering the synthetically commutated dual stage hydraulic pump 27 through a fluid inlet 31 with a large fluid supply cross section 32, first reaches the charging stage 28 of the synthetically commutated dual stage hydraulic pump 27. The charging stage 28 is essentially comprised of a plate 33 and an impeller disc 34, which is arranged adjacent to the plate 33. When the shaft 30 is turning, hydraulic fluid is pumped to mid-pressure chamber 35. Here, the hydraulic fluid rests at an elevated pressure of 2 or 3 bars above ambient pressure, for example. The high pressure stage 29 of the synthetically commutated dual stage hydraulic pump 27 comprises pistons 40, turnably sliding on a wobble plate 41. When the shaft 30 is rotated, the wobble plate 41 causes the pistons 40 to reciprocally move in and out of their respective cylinder spaces 42. Thus, a working chamber 37 of cyclically changing volume is provided. In a pumping mode, when the volume of the working chamber 37 increases, the inlet valve 36 (which is electrically actuatable) will be opened by an appropriate actuator unit. Because of the pressure present in the mid-pressure chamber 35, the hydraulic fluid is not only sucked into the working chamber 37 by under-pressure within the working chamber 37, but is also pushed into the working chamber 37 by the pressure within the mid-pressure chamber 35. Because of this, the fluid supply cross-section of the inlet valve 36 can be smaller, compared to common hydraulic pumps. Furthermore, higher operating speeds of the synthetically commutated dual stage hydraulic pump 27 can be reached. Is should be noted, that in the example shown, a higher driving speed will lead to a better performance of the loading stage 28 as well, so that the pressure in the mid-pressure chamber 25 will increase accordingly.

As soon as the volume of the working chamber decreases, inlet valve 36 will be closed (at least in the full stroke pumping mode) and passive outlet valve 38 will open, as soon as an appropriate pressure difference between the working chamber 37 and the high pressure fluid line 43 has been established.

However, it is still possible to switch the synthetically commutated dual stage hydraulic pump 27 to a partial stroke pumping mode. The elevated pressure in the mid-pressure chamber 35 is not that high, that fluid cannot be expelled back into the mid-pressure chamber 35 from the working chamber 37.

The high-pressure fluid lines 43 of the synthetically commutated dual stage hydraulic pump 27 connect within the pump's body to a common fluid manifold 44. The fluid manifold 44 is consequently connected to a fluid output port 45.

Figure 6B:
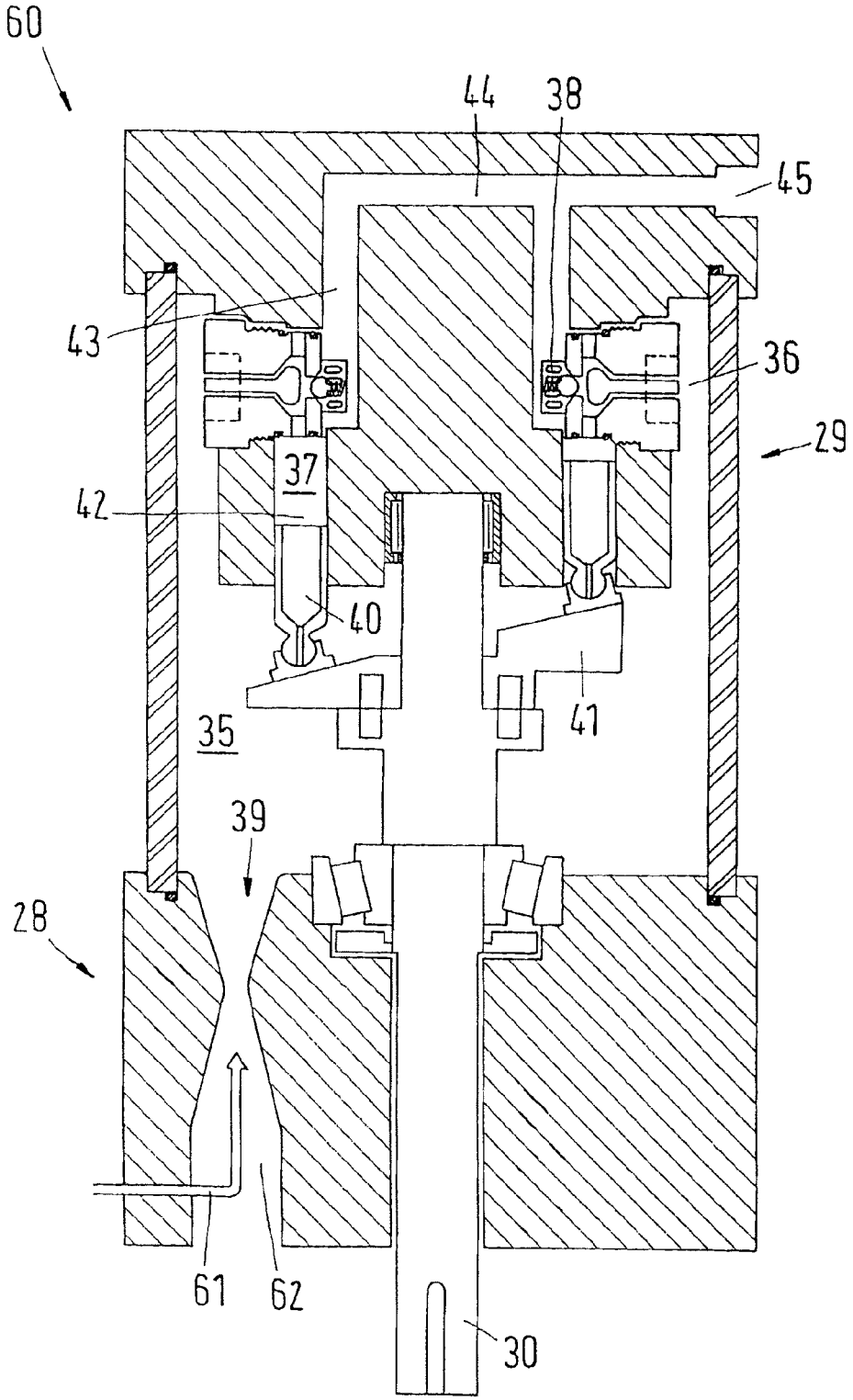
FIG. 6B is a second example of an integrated hydraulic pump with a charging stage and a high-pressure stage.

FIG. 6B shows a second example of a dual-stage hydraulic pump 60, comprising a charging stage 28 and a high-pressure stage 29. Up to a quite large extent, the two examples of the dual-stage hydraulic pumps 27, 60 shown in FIG. 6A and FIG. 6B, are similar to each other. Therefore, the same reference No. are used for similar parts.

In particular, the high-pressure stage 29 of the dual-stage hydraulic pump 60 is almost identical to the dual-stage hydraulic pump 27, shown in FIG. 6A. The details can therefore be looked up from the previous description. Different from the first example 27 in FIG. 6A, the present dual stage hydraulic pump 60 of FIG. 6B shows a different charging stage 28. In the present embodiment, the charging stage 28 shows a fluid jet pump 39. As commonly known, a fluid jet pump 39 consists essentially of an injector 61 and a venturi channel 62. In the present example, the entrance of the venturi channel 62 is fluidly connected to a fluid reservoir 5. The injector 61 is fed by the return flow from a hydraulic consumer, e.g. by the return flow from a power steering. The pressure can be at 10 bar, while the flow rate can be set at 10 l/min. Using the fluid jet pump 39, the fluid flow, flowing through the injector 61 is amplified by the flow, flowing through the venturi channel 62, and the combined fluid flows (back flow from power steering and additional flow from a reservoir) are entering the mid-pressure chamber 35.

Because of the charging stage 28 being designed as a fluid jet pump 39, the plate 33 and the impeller disc 34, which is present in FIG. 6A, can be omitted.

FIG. 7 shows a standard synthetically commutated hydraulic pump 46, as known in the state of the art. The cyclically changing working chamber 47 is formed by a piston part 48 and a cylinder part 49. The cylinder part 49 and the piston part 48 are moved reciprocally in and out of each other by the joint forces of a cam 50, mounted on a rotatable shaft 51 and a spring 52, pushing the piston part 48 and the cylinder part 49 away from each other. An electrically actuated inlet valve 53 connects the inlet line 54 to the working chamber 47. Accordingly, a fluid outlet valve 55 connects the working chamber 47 to a fluid outlet line 56.

As can be seen from the standard synthetically commutated hydraulic pump 46, shown in FIG. 7, the fluid supply cross-section 57 of the inlet valve 53 has to be very large. The valve head has to be very large. Therefore, a appropriately strong valve actuating unit 59 has to be provided. This valve actuating unit 59, however, uses a lot of energy.

Figure 8A:
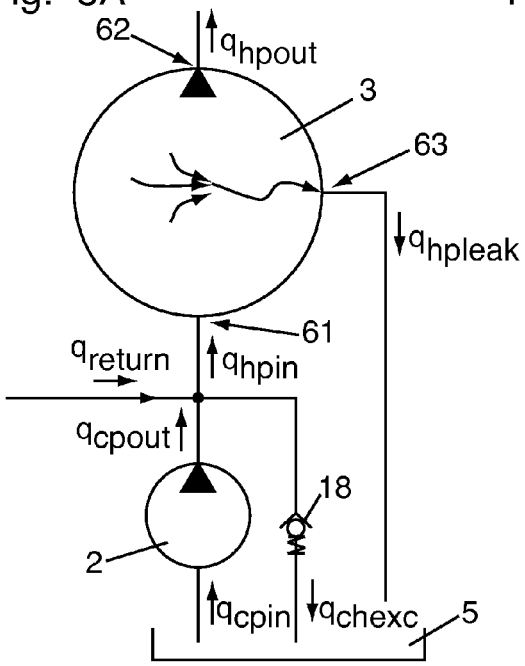
FIG. 8A, 8B is an illustration of the mutual dependency of the different fluid flow rates in charged hydraulic systems.
Figure 8B:
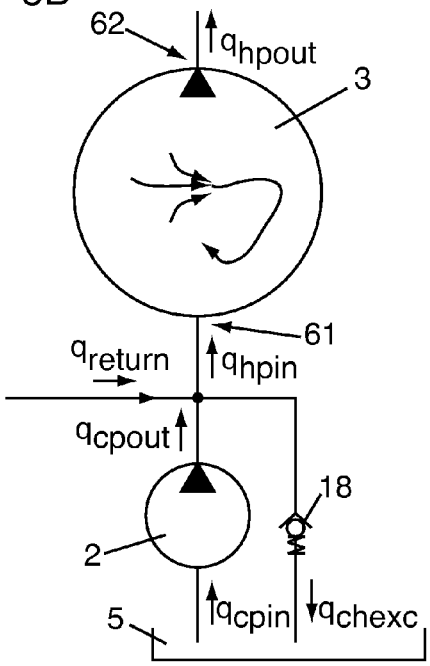

In FIGS. 8A and 8B a schematics of the different fluid flow rates in the vicinity of the hydraulic charge pump 2 and the hydraulic high-pressure pump 3 is shown. From this, conclusions about the sizing of the charge pump 2 and the high-pressure pump 3 can be drawn.

To prevent cavitation of the high-pressure pump 3 (which is preferably of the synthetically commutated type) the pressure on the inlet port 61 of the hydraulic high-pressure pump 3 has to be maintained at a suitable level under all operating conditions as already described earlier. To make the whole hydraulic pumping system of a certain machine as cost effective as possible, the charge pump 2 should be made as small as possible. If possible (which depends mainly on the hydraulic consumers) the output flow from the charge pump $q_{cpout}$ (where $_{cpout}$ stands for "charge pump output flow rate") and the return flows from the sub-systems $q_{return}$ are combined and elevated to a suitable charge pressure using for instance the check valve 18 with a suitable spring rate. Alternatively a pressure relief valve or maybe even a correctly sized orifice can be used. To be able to sustain such a suitable charge pressure, the following equation should hold:

$$q_{return}+q_{cpout}=q_{hpin}+q_{chexec} \quad (1),$$

where $q_{return}$ is the return flow rate from sub-systems, $q_{cpout}$ is the charge pump output flow rate, $q_{hpin}$ is the charge pump inlet flow rate and $q_{chexec}$ is the excess charge flow rate, which is returned to the fluid tank 5. Of course, in practice usually only positive values are possible for the different fluid flow rates.

The exact value of the charge pressure at the inlet port 61 of the hydraulic high-pressure pump 3 might vary under different operating conditions but the system has to be designed in a way that under all circumstances sufficient charge pressure is provided and cavitation in the hydraulic high-pressure pump 3 is prevented.

If no return flow from sub-systems is available (i.e. $q_{return}=0$) the charge pump has to be sized in a way that sufficient charge pressure for the hydraulic high pressure pump 3 is always guaranteed. In such a case a self-delimiting charge pump, e.g. an impeller or a jet pump, might be the most cost effective solution. In this case, a purge valve 18 can even be omitted, because equation (1) can be solved with a constant $q_{chexec}=0$. This is because $q_{cpout}$ will be automatically set to the appropriate level by the self-delimiting behaviour of charge pump 2.

However, it is also possible to use a positive displacement pump for the charge pump 2, together with a purge valve 18.

It should be mentioned, that it is also possible to solve equation (1) by reducing $q_{hpin}$. If in a hydraulic system at most only once in a while the fluid flow demand on the high-pressure side $q_{hpout}$ is very high or the return flow rate from sub-systems $q_{return}$ is very low, the pumping rate of the high-pressure pump 3 can be reduced by an electronic controlling unit (not shown). This way, cavitation in the high-pressure pump 3 can be avoided as well. Of course, the fluid output flow rate $q_{hpout}$ will be correspondingly low. However, for certain applications this might not be a problem, especially if this situation only rarely occurs.

In FIGS. 8A and 8B, two different basic designs of the hydraulic high-pressure pump 3 are illustrated.

FIG. 8A shows a hydraulic high-pressure pump 3 with inlet port 61, outlet port 62 and additional leakage collecting port 63, to return internal leakage 64 to the fluid tank 5.

FIG. 8B shows a similar circuit that uses the hydraulic high-pressure pump 3 without a dedicated port for internal leakage 64.

In FIG. 8A the high-pressure pump's input flow rate $q_{hpin}$ has to make up for the oil flow on the leakage port 63 $q_{hpleak}$ ($h_{pleak}$ for "high-pressure leakage"). This is not necessary for the system, shown in FIG. 8B, because the internal leakage 64 of the hydraulic high-pressure pump 3 stays inside the hydraulic high-pressure pump 3 and does not have to be replaced.

The following equations can be used for charge pump sizing:

$$q_{hpout}+q_{hpleak}=q_{hpin} \quad (2)$$

$$q_{hpin}+q_{chexec}=q_{return}+q_{cpout} \quad (3),$$

where $q_{hpout}$ is the high-pressure pump output flow rate, $q_{hpleak}$ is the high-pressure pump internal leakage flow rate, $q_{hpin}$ is the high-pressure pump inlet flow rate, $q_{chexec}$ is the excess charge flow rate returned to fluid tank 5, $q_{return}$ is the return flow rate from the sub-systems and $q_{cpout}$ is the charge pump output flow rate.

The system designer should ensure that always a minimum charge excess flow $q_{chexec}$ remains through the purge valve 18. The limit is when $q_{chexec}$ becomes zero. In this case equation (3) becomes $$q_{hpin}=q_{return}+q_{cpout} \quad (4)$$

and $$q_{hpout}+q_{hpleak}=q_{return}+q_{cpout} \quad (5).$$

In case no return flow from hydraulic sub-systems is present (i.e. $q_{return}$=zero) we will get $$q_{hpout}+q_{hpleak}=q_{cpout}, \text{ in case of FIG. 8A} \quad (6)$$

$$q_{hpout}=q_{cpout}, \text{ in case of FIG. 8B} \quad (7).$$

The system designer should make sure that these rules are fulfilled under all operating conditions. In particular it is important to clearly understand return flow rates $q_{return}$ from loads especially when differential hydraulic cylinders are involved.

Figure 9:
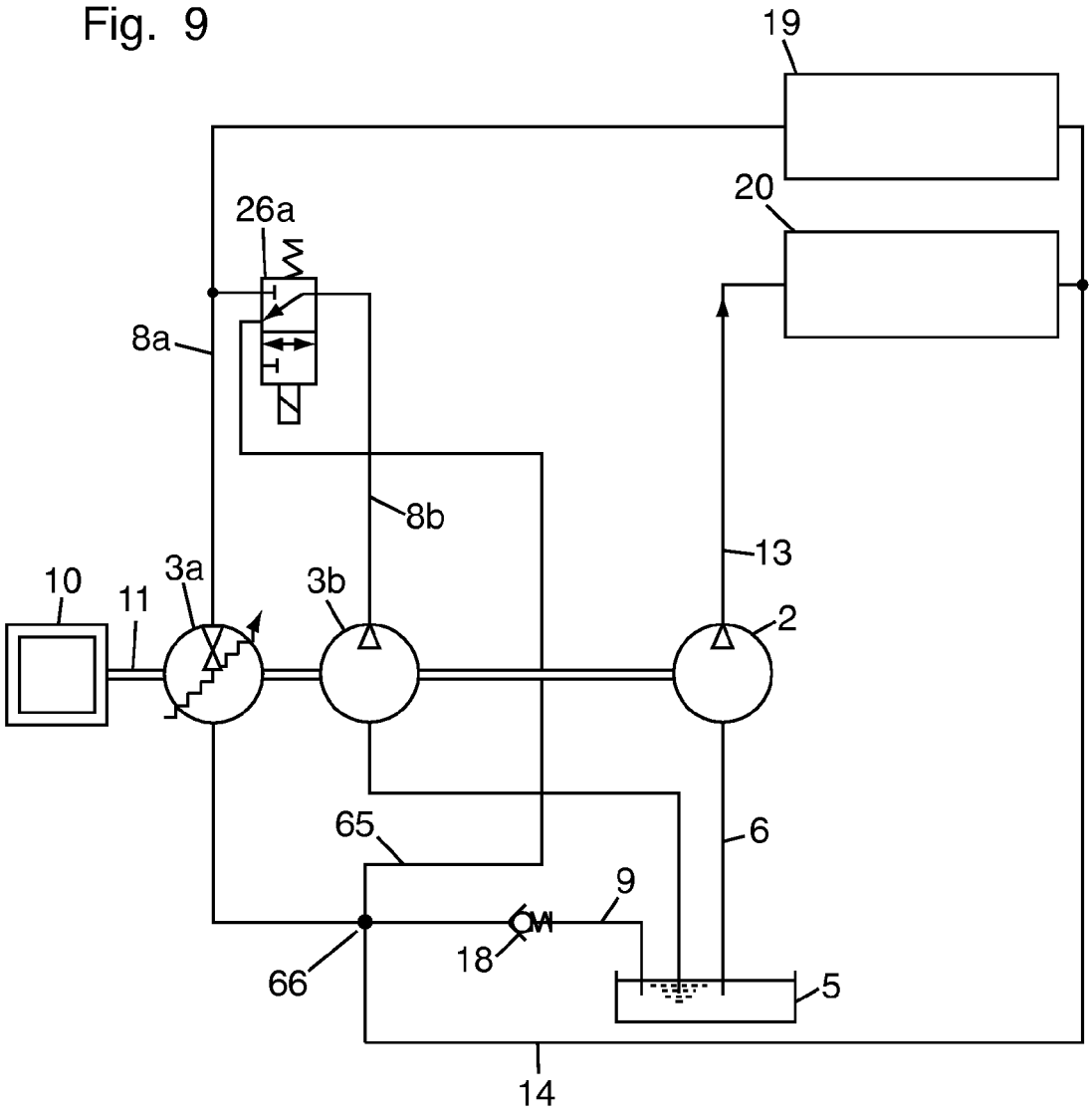
FIG. 9 is an exemplary example, illustrating the principles, shown in FIG. 8A/B.

FIG. 9 shows another example of a hydraulic system and how the return flows from several hydraulic consumers 19, 20 can be used in a cost effective manner for charging the hydraulic high-pressure pump 3*a*. Pump 3*b* is a second hydraulic high-pressure pump. For cost reasons, most likely a fixed displacement pump will be used for second hydraulic high-pressure pump 3*b* (instead of a synthetically commutated hydraulic pump, as used for first hydraulic high-pressure pump 3*a*). Pump 3*b* acts as a supplement pump to supply extra flow on a high-pressure level into hydraulic consumer 19 if needed—e.g. for a higher propel speed of a vehicle, driven by a hydraulic motor. Switching of valve 26*a* will be synchronised with changing the output flow rate of synthetically commutated pump 3*a* by an electronic controlling unit (not shown). Since synthetically commutated pumps can change their output flow rate almost instantaneously, they can compensate switching supplement pump 3*b* in and out in an almost ideal manner. Particularly, the combined fluid output flow rate of first and second hydraulic high-pressure pumps 3*a* and 3*b* can be continuous.

As a guideline for the sizing of the pumps in particular for the sizing of the first and second hydraulic high-pressure pump 3*a*, 3*b*, supplement high-pressure pump 3*b* ideally should be slightly smaller than first hydraulic high-pressure pump 3*a*. This assumes, that both pumps 3*a*, 3*b* are driven at the same speed. Otherwise, the ratio of the different shaft speeds has to be considered for the design of the systems. For the present description, however, it is assumed that all pumps are driven with the identical shaft speed through a common shaft 11.

Making supplement high-pressure pump 3*b* smaller than first hydraulic high-pressure pump 3*a* ensures that the high performance (high bandwidth) pump 3*a* maintains control of a flow rate, pressure etc. into hydraulic consumer 19.

As soon as valve 26*a* activates high-pressure supplement pump 3*b* (flow from supplement pump 3 is added into hydraulic consumer 19) first high-pressure pump 3*a* has to instantaneously reduce its output flow rate to maintain constant input flow rate into hydraulic consumer 19.

Because high-pressure supplement pump 3*b* is at least slightly smaller than first high-pressure pump 3*a* the return flow from hydraulic consumer 19 plus the flow from purge line 65 is not sufficient to charge the first high-pressure pump 3*a*. In the embodiment shown in present FIG. 9 the missing charge flow rate comes from a third pump 2 which like the high-pressure supplement pump 3 intakes hydraulic fluid from the atmospheric fluid reservoir 5 directly. The total displacement of pump 2 and high-pressure supplement pump 3*b* has to be at least equal to, but realistically bigger than the displacement of first high-pressure pump 3*a*. How much bigger depends on the internal leakages and the type of the hydraulic consumer 19 used. In case hydraulic consumer 19 is a hydraulic motor (or several hydraulic motors in series or parallel) the return flow from hydraulic consumer 19 will be the input flow into hydraulic consumer 19 minus the leakage of the motors. In such case the total displacement of pump 2 and high-pressure supplement pump 3*b* only has to be slightly bigger than the displacement of first high-pressure pump 3*a*. In case hydraulic consumer 19 contains differential cylinders or the like, the worst case (i.e. lowest ratio of input flow rate and return flow rate to and from hydraulic consumer 19, respectively) has to be considered for sizing of pump 2. In the same way the internal architecture of hydraulic consumer 20 has to be considered. In case hydraulic consumer 20 is a steering system the output flow rate of hydraulic consumer 20 should be very close to the input flow rate at all times (internal leakage of hydraulic consumer 20 is smaller).

The system designer should make sure that under all operating conditions the total flow rate into summation point 66 is sufficiently high to provide suitable charge pressure into first high-pressure pump 3*a*. If this can be guaranteed it might be better to choose one of the other proposed architectures and e.g. use a self-delimiting charge pump. One preferred case is a system in which the hydraulic consumer 19 are hydraulic motors and hydraulic consumer 20 a steering system. In this case high-pressure supplement pump 3*b* is switched in for higher road speeds. In this particular case the maximum power of the engine only allowed relatively moderate system pressures for higher road speeds and a gear pump for high-pressure supplement pump 3*b* was selected according to a certain exemplary embodiment. This resulted in a very cost effective overall system layout.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hydraulic system comprising a hydraulic high pressure pump, a hydraulic charging pump, and at least first and second hydraulic consumers, wherein an output flow of said hydraulic high pressure pump passes through the first hydraulic consumer, wherein an output hydraulic fluid flow of said hydraulic charging pump passes through the second hydraulic consumer and is then combined with the output flow of the hydraulic high pressure pump after it passes through the first hydraulic consumer, the combined flow being used as an input hydraulic fluid flow of said hydraulic high pressure pump, wherein the system is adapted to feed the second hydraulic consumer from a combination of the output flows of at least a second hydraulic high pressure pump and the hydraulic charging pump, wherein a maximum flow of said output fluid flow of said hydraulic charging pump is at least 50 percent of a maximum flow rate of said input fluid flow of said hydraulic high pressure pump, and wherein the hydraulic high pressure pump is a synthetically commutated hydraulic pump having at least one actively controllable fluid inlet or outlet valve.

2. The hydraulic system according to claim 1, wherein the maximum flow rate of said output fluid flow of the hydraulic charging pump is at least essentially the same as or higher than the maximum flow rate of said input fluid flow of said hydraulic high pressure pump.

3. The hydraulic system according to claim 1, wherein the output pressure of said hydraulic charging pump is 0.3 to 10 bars.

4. The hydraulic system according claim 1, wherein the hydraulic high pressure pump and the hydraulic charging pump are driven by a single power source.

5. The hydraulic system according to claim 1, wherein the hydraulic charging pump is of a self-delimiting type.

6. The hydraulic system according to claim 1, wherein the output pressure of said hydraulic charging pump is 0.5 to 7 bars.

7. The hydraulic system according to claim 1, wherein the output pressure of said hydraulic charging pump is 1 to 5 bars.

8. The hydraulic system according to claim 1, wherein the output pressure of said hydraulic charging pump is 1.5 to 3 bars.

9. The hydraulic system according to claim 1, wherein the output pressure of said hydraulic charging pump is 2 to 2.5 bars.

10. A hydraulic system, comprising at least a first, charging stage, a second, high pressure stage, and at least first and second hydraulic consumers;

wherein an output flow of the second, high pressure stage passing through the first hydraulic consumer;

wherein an output hydraulic fluid flow of the first, charging stage passes through the second hydraulic consumer and is then combined with the output flow of the second, high pressure stage after it passes through the first hydraulic consumer, the combined flow being used as an input hydraulic fluid flow for the second, high pressure stage;

wherein the system is adapted to feed the second hydraulic consumer from a combination of the output flows of at least a third, high pressure stage, and the first, charging stage; and wherein at least the second, high pressure stage is of a synthetically commutated type having at least one actively controllable fluid inlet or outlet valve.

11. The hydraulic system according to claim 10, wherein said charging stage comprises an impeller device.

12. The hydraulic system according to claim 10, wherein both stages are driven by a common driving shaft, and are mounted on said driving shaft.

* * * * *